United States Patent [19]

Stohrer, Jr.

[11] Patent Number: 4,626,196

[45] Date of Patent: Dec. 2, 1986

[54] SPARK IGNITED GAS BURNER

[75] Inventor: Charles E. Stohrer, Jr., Hickory Hills, Ill.

[73] Assignee: Harper-Wyman Company, Hinsdale, Ill.

[21] Appl. No.: 779,646

[22] Filed: Sep. 23, 1985

[51] Int. Cl.[4] ..... F23Q 3/00

[52] U.S. Cl. ..... 431/264; 126/39 E

[58] Field of Search ..... 126/39 E, 39 R, 214 R, 126/214 A, 214 C, 214 D; 431/154, 196, 264, 266

[56] References Cited

U.S. PATENT DOCUMENTS

| | | | |
|---|---|---|---|
| 2,960,980 | 11/1960 | William et al. | 126/39 |
| 4,518,346 | 5/1985 | Pistien | 431/266 |

FOREIGN PATENT DOCUMENTS

| | | | |
|---|---|---|---|
| 2501576 | 7/1976 | Fed. Rep. of Germany | 431/266 |
| 2372577 | 7/1978 | France | 431/264 |
| 2408096 | 7/1979 | France | 431/264 |
| 2414681 | 9/1979 | France | 431/264 |
| 614866 | 1/1961 | Italy | 431/264 |
| 7808145 | 2/1980 | Netherlands | 431/264 |
| 1175225 | 12/1969 | United Kingdom | 431/264 |
| 1450153 | 9/1976 | United Kingdom | 431/266 |
| 1543618 | 4/1979 | United Kingdom | 431/266 |
| 1544624 | 4/1979 | United Kingdom | 126/39 E |
| 2085576 | 4/1982 | United Kingdom | 431/264 |

*Primary Examiner*—Margaret A. Focarino

*Attorney, Agent, or Firm*—Mason, Kolehmainen, Rathburn & Wyss

[57] ABSTRACT

A gas burner assembly includes a metal burner body with main burner ports formed in a sidewall containing an internal fuel chamber. An electrically conductive burner top member overlies the burner body. The top member and body are electrically isolated from one another and are spaced apart to define an ignition gas pathway extending from the internal chamber to an ignition region above the main burner ports. A spark ignition circuit includes a spark gap in series circuit relationship between the burner body and the top member. Fuel supplied to the fuel chamber flows through the ignition gas pathway, is ignited by sparking at the spark gap and in turn ignites fuel flowing from the main burner ports.

9 Claims, 5 Drawing Figures

SPARK IGNITED GAS BURNER

The present invention relates to gas burners and more particularly to an improved burner assembly for spark ignition.

In the past it was conventional automatically to ignite burners such as gas range top burners from a standing igniter pilot flame. In a typical arrangement, a number of burners were communicated by flash tubes with a standing pilot. Fuel supplied to a burner traveled through the flash tube to the pilot and the burner was ignited by flashback.

More recently, spark ignition is supplanting standing pilot ignition in order to avoid the energy consumption and heat caused by standing pilots. In one type of spark ignition system, the central standing pilot is replaced with a spark gap electrode assembly such as that disclosed in U.S. Pat. No. 3,523,747. This arrangement retains the preexisting range top configuration including flash tubes.

Other approaches have been proposed to make more effective use of electronic ignition. An ignition spark gap has been provided at each burner so that flash tubes are not required. In one arrangement, a spark electrode in the form of a probe is associated with each burner to ignite fuel at a special ignition port or at a main burner port. This can require expensive manufacturing and assembly operations. Moreover, placing a spark electrode in the flame path or providing special lighter ports can disturb the burner flame uniformity and reduce flame efficiency.

It has also been proposed to use components of the burner itself as spark electrodes rather than providing a separate probe. According to this proposal the ignition sparks traverse main burner ports formed in an insulating body, for example of ceramic material. Problems with this arrangement include difficulty in achieving reliability in ignition at a wide range of fuel flow rates and inapplicability of this concept to less expensive burners with ports formed in a metal burner body. In addition, the tendency for ceramic materials to semiconduct at elevated temperatures makes this proposal unsatisfactory for use use with spark ignition circuits capable of detecting flame at the spark gap.

Gas range top configurations have typically included a burner box in which a number of burners, fuel supply venturis, flash tubes and other components have been located. The venturis mix gas with air to provide a primary air-gas mixture. This mixture is further mixed with secondary air in the region of the burner ports. Secondary air has typically been provided from an aeration bowl within the burner box and flows up around the burner. This general arrangement has been retained even when spark ignition is used instead of a flash tube arrangement. Due to spillage from the range top down around the burners, the burner box requires a bottom wall and periodic cleaning of the burner box area is necessary. Although closed top burners using infrared heat transfer provide a more easily cleaned configuration, due to expense and other factors this type of burner has not supplanted open flame gas range tops in the marketplace.

Among the important objects of the present invention are to provide an improved gas burner assembly for spark ignition; to provide a burner assembly in which uniform flame characteristics are achieved; to provide a gas burner assembly requiring no separate spark probe electrode and exhibiting reliable ignition throughout a wide range of flow rates; to provide a burner assembly in which the presence of flame may be detected; to provide a burner assembly making possible a simplified, less expensive and easily cleaned open flame range top configuration; and to provide a burner assembly overcoming the disadvantages of various types of burner assemblies proposed in the past.

In brief, the above and other objects of the present invention are realized in one embodiment of the invention by a gas burner assembly including a metal burner body. The burner body includes a sidewall within which is contained an internal fuel chamber. An array of main burner ports are formed in the burner body sidewall. An electrically conductive burner top member overlies the burner body and the fuel chamber. Spacer means sandwiched between the burner body and the top member space apart and electrically isolate the top member from the burner body. An ignition gas pathway is defined between the burner body and the top member. The pathway extends from the internal chamber to an ignition region above the main burner ports. A spark ignition circuit includes a spark gap in series circuit relationship between the burner body and the top member for providing ignition sparks in the ignition region.

The invention and its objects and advantages may be better understood from consideration of the following detailed description of the embodiments of the invention illustrated in the accompanying drawings in which.

Figure 1:
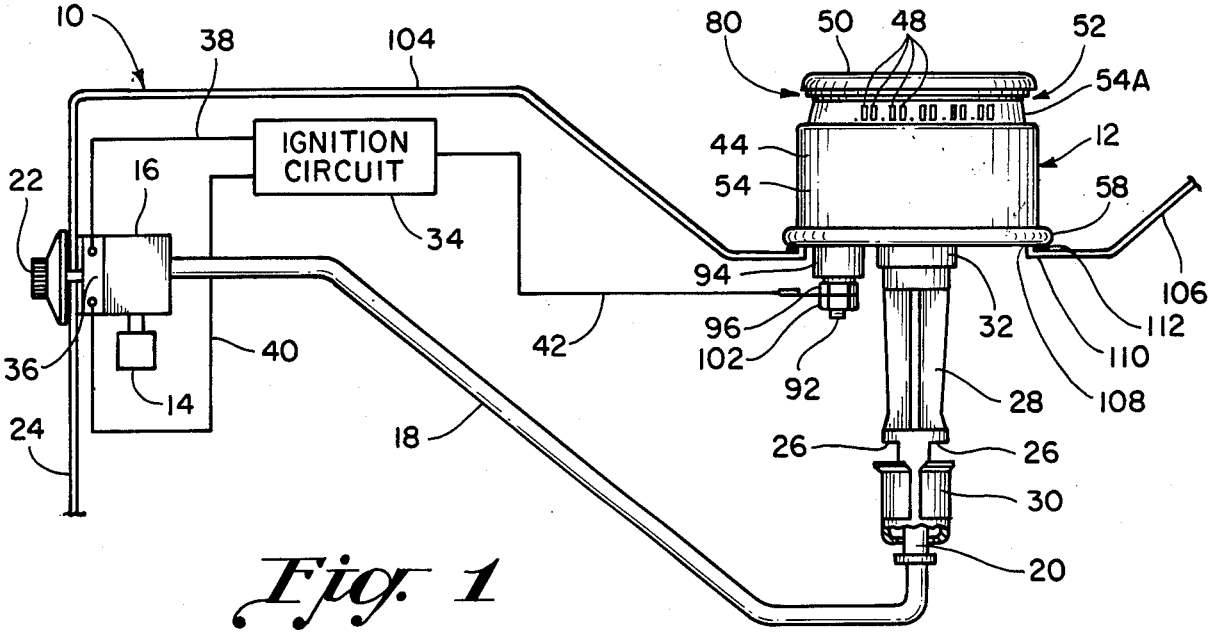
FIG. 1 is a largely diagrammatic and schematic illustration of a portion of a range top including a burner assembly constructed in accordance with the invention.

With reference now to the drawings, FIG. 1 illustrates in diagrammatic form a portion of a range top or cooking top 10 including a gas burner assembly generally designated as 12 constructed in accordance with the principles of the present invention. Although a single burner 12 is illustrated for purposes of description, top 10 may include a number, such as four, of similar burner assemblies.

Gas is supplied to the burner assembly 12 from a gas supply manifold 14 through a top burner valve 16 and conduit 18 terminating at an orifice fitting 20. Burner flame size is selected by adjustment of the gas flow rate with a control knob 22 accessible at a front wall 24 of the range top 10. Gas supplied from the fitting 20 entrains primary air through openings 26 in a venturi tube 28. The openings 26 are controlled by an adjustable shutter 30, and the combustible mixture of gas and primary air is supplied to the burner assembly 12 through an inlet flange 32.

Gas flow through the valve 16 may be controlled by adjustment of the control knob 22 from an off or closed condition to a wide range of gas flow rates. An ignition circuit generally designated as 34 generates ignition sparks for the burner assembly 12 under the control of a valve switch 36 associated with the top burner valve 16. The valve 16 and the switch 36 may be generally of the character disclosed in U.S. Pat. No. 4,249,047, hereby incorporated by reference. Electrical conductors 38 and 40 of ignition circuit 34 are connected to the switch 36, while an additional electrical conductor 42 is connected to the burner assembly 12.

In accordance with the invention, spark ignition is effected at the burner assembly 12 without flow disruption caused by a discrete spark electrode probe in the gas flow or by a non-symmetrical ignition gas port. Moreover, an economical burner port fabrication is permitted while obtaining reliable ignition throughout the wide range of gas flow rates permitted by the valve 16.

Figure 2:
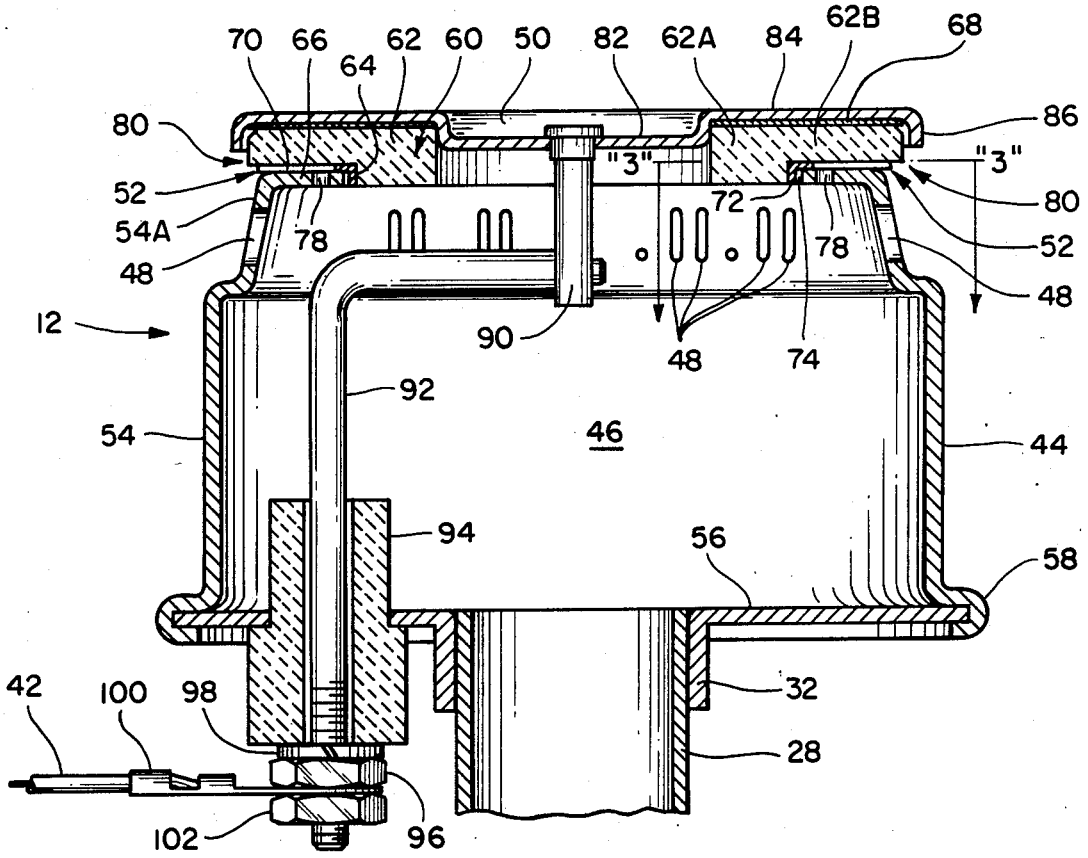
FIG. 2 is a sectional view of the burner assembly.

Burner assembly 12 as illustrated in more detail in FIG. 2 includes a generally cylindrical burner body 44 enclosing a fuel chamber 46 to which an air-gas mixture is supplied from venturi 28. Fuel flows from chamber 46 through an array of main burner ports 48. An ignition gas pathway is defined above the burner body 44 and below a burner top member 50. When gas flow to the burner is initiated by operation of valve 16, ignition sparks are created at a spark gap 52 between the burner body 44 and top member 50 for igniting fuel at the ignition gas pathway, thereby in turn igniting fuel flowing from the main burner ports 48.

Proceeding to a more detailed description of the burner assembly 12, an economical construction is possible because the burner body 44 including ports 48 is stamped sheet metal. In the illustrated embodiment of the invention, the burner body 44 includes a generally circular, upstanding sidewall 54 with an upper inset and slightly angled portion 54A in which the ports 48 are formed by a simple punching operation. A bottom plate 56 including the inlet flange 32 is clinched by a flange 58 of the burner body 44. The upper portion of venturi 28 may be press fit or otherwise attached to the flange 32.

A spacer assembly 60 separates and electrically isolates the burner body 44 from the top member 50 and in addition defines the ignition gas pathway of the burner assembly. Assembly 60 includes a spacer member 62 having a centering projection 62A received in a central opening 64 formed in a top wall 66 of the burner body 44. A radially extending circular flange 62B of spacer 62 spaces apart the top member 50 from the burner body top wall 66.

As described below, the ignition circuit 34 includes circuitry for detecting the presence or absence of flame at the burner assembly 12. In the illustrated embodiment of the invention, spacer member 62 is formed of a ceramic material which may become semiconductive when heated by burner flame. Such conduction may interfere with the detection of flame, and for this reason a washer-like disk 68 of tempera- ture-independent insulating material such as sheet mica is sandwiched between the spacer 62 and the burner top member 50.

Figure 3:
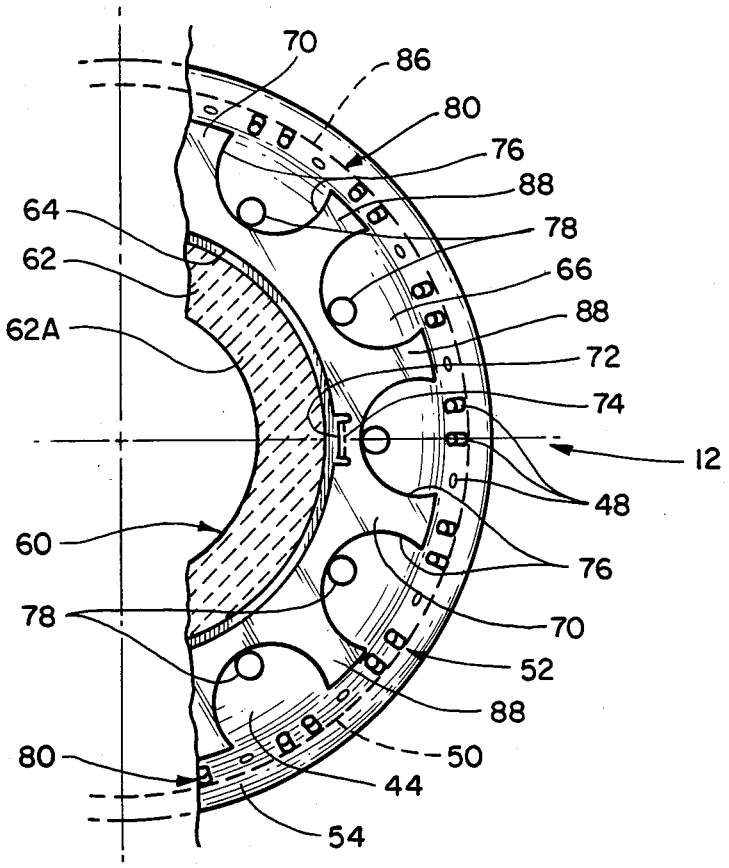
FIG. 3 is a fragmentary sectional view taken along the line 3—3 of FIG. 2.

As best seen in FIG. 3, the ignition gas pathway is defined between the flange 62B of spacer 62 and the top wall 66 of the burner body 44 by a gasway spacer plate 70. In general outline, spacer plate 70 is annular and includes an inside diameter generally coinciding with the centering projection 62A of the spacer 62. At one or more selected locations around its inside diameter, plate 70 includes an indexing tab 72 received in a slot 74 of the burner body. Around its outer periphery, plate 70 includes numerous recesses or scallops 76 each aligned by tab 72 and slot 74 with a corresponding ignition gas opening 78 formed in the burner body top wall 66. When fuel is supplied to the burner assembly 12, ignition gas flows from chamber 46 through the openings 78 and scallops 76 to an ignition region 80 continuous around the burner assembly between the outer circumference of the burner top member 50 and the burner body 44.

Spark gap 52 for igniting fuel flowing from burner assembly 12 coincides with the ignition region 80. Burner top member 50 includes a radially inner projecting portion 82 received within projection 62A of spacer 62 for centering the top member 50 with respect to the burner assembly. An annular portion 84 overlies the spacer 62 and the insulating disk 68. A continuous circumferential depending flange 86 extends downwardly toward the burner body 44 and comprises one spark electrode of the spark gap 52.

The other spark electrode in the illustrated arrangement is defined by any one or more of numerous radially outwardly extending fingers 88 of the spacer plate 70 alternately disposed between the recesses or scallops 76. Since fingers 88 extend radially outward beyond the burner body top wall 66, the spark path extends to fingers 88 rather than to the burner body itself. If desired, the configuration of the plate 70 may be such that sparking occurs directly between the top member 50 and the burner body 44.

The top member 50 is electrically connected to conductor 42 of the ignition circuit 34 by means of a stud 90 attached to central portion 82 of member 50 and a rod 92 attached to stud 90. The central inlet flange 32 of the burner assembly provides balanced gas flow for uniform flame configuration without baffling within the burner body 44. Rod 92 is offset or L-shaped to accommodate the central fuel inlet and extends downwardly through the bottom plate 56. An insulator 94 receives rod 92 and maintains the electrical isolation between the burner body 44 and top member 50.

As illustrated in FIG. 2, the lowermost segment of rod 92 is threaded. A nut 96 and lock washer 98 received on rod 92 hold together the components of the burner assembly 12 including the body 44, the spacer assembly 60 and the top member 50. Manufacture of the burner assembly 12 is facilitated because a single fastener holds the components in compression against one another. Electrical connection is made to the conductor 42 by means of a crimp ring terminal 100 and a second nut 102.

Figure 4:
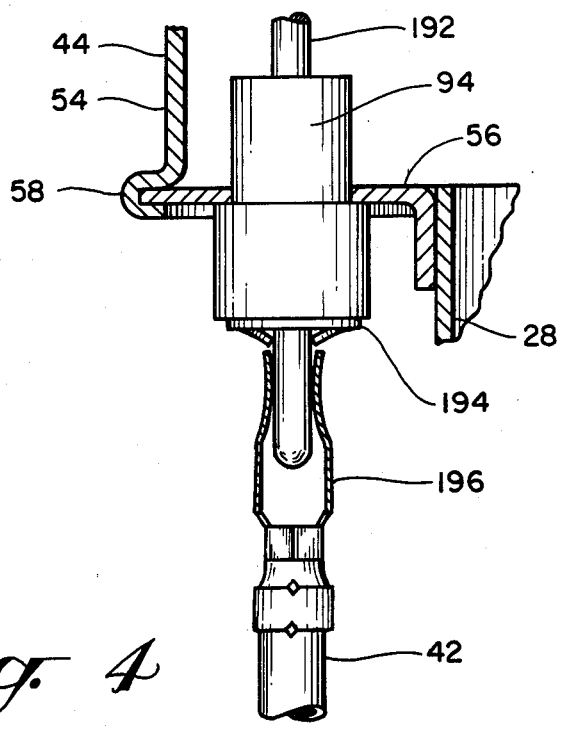
FIG. 4 is a fragmentary sectional view showing an alternative electrode connection for the burner assembly.

In FIG. 4 there is illustrated an alternative arrangement including a rod 192, the lowermost portion of which may but need not be threaded. In place of the nut and washer 96 and 98, a sheet metal spring clip fastener 194 is received on rod 192 against the insulator 94 to hold the burner assembly in assembled relation. A crimp spring terminal 196 interconnects the conductor 42 with the rod 192. An advantage of the FIG. 4 arrangement is that the spring clip fastener 194 prevents easy disassembly of the burner assembly by the user so that problems resulting from a possible misassembly of the burner are avoided. Another advantage is that the burner assembly 12 can be connected both to the conduit 18 and orifice fitting 20 and also to the conductor 42 simply by placing the burner assembly in position on the range top 10, with rod 192 being received between spring contacts of the terminal 196 while fitting 20 is received by venturi tube 28. To achieve this result, the spring terminal 196 may be supported in a fixed position within the range top 10.

Referring again to FIG. 1, it can be seen that the burner assembly 12 of the present invention makes possible a simple and easily cleaned range top or cooking top configuration. As illustrated, the range top includes a top wall 104 which is imperforate and includes no openings or spaces where spillover from a cooking vessel or the like can enter the region below the wall 104. A dished or recessed area 106 surrounding burner assembly 12 permits secondary air for combustion at the burner ports 48 to flow from above the range top rather than from an internal burner box location. The burner assembly 12 is received at an opening 108 bounded by a flange 110 upon which the flange 58 or the bottom wall 56 rests. A gasket 112 may be employed to seal the interior of the range top 10. A cooking grate (not shown) may be supported upon the top wall 104 to support a cooking vessel above the burner assembly 12. If desired, the valve 16 and knob 22 together with associated components may be disposed in the top wall 104 or other convenient location rather than in the front wall 24.

Figure 5:
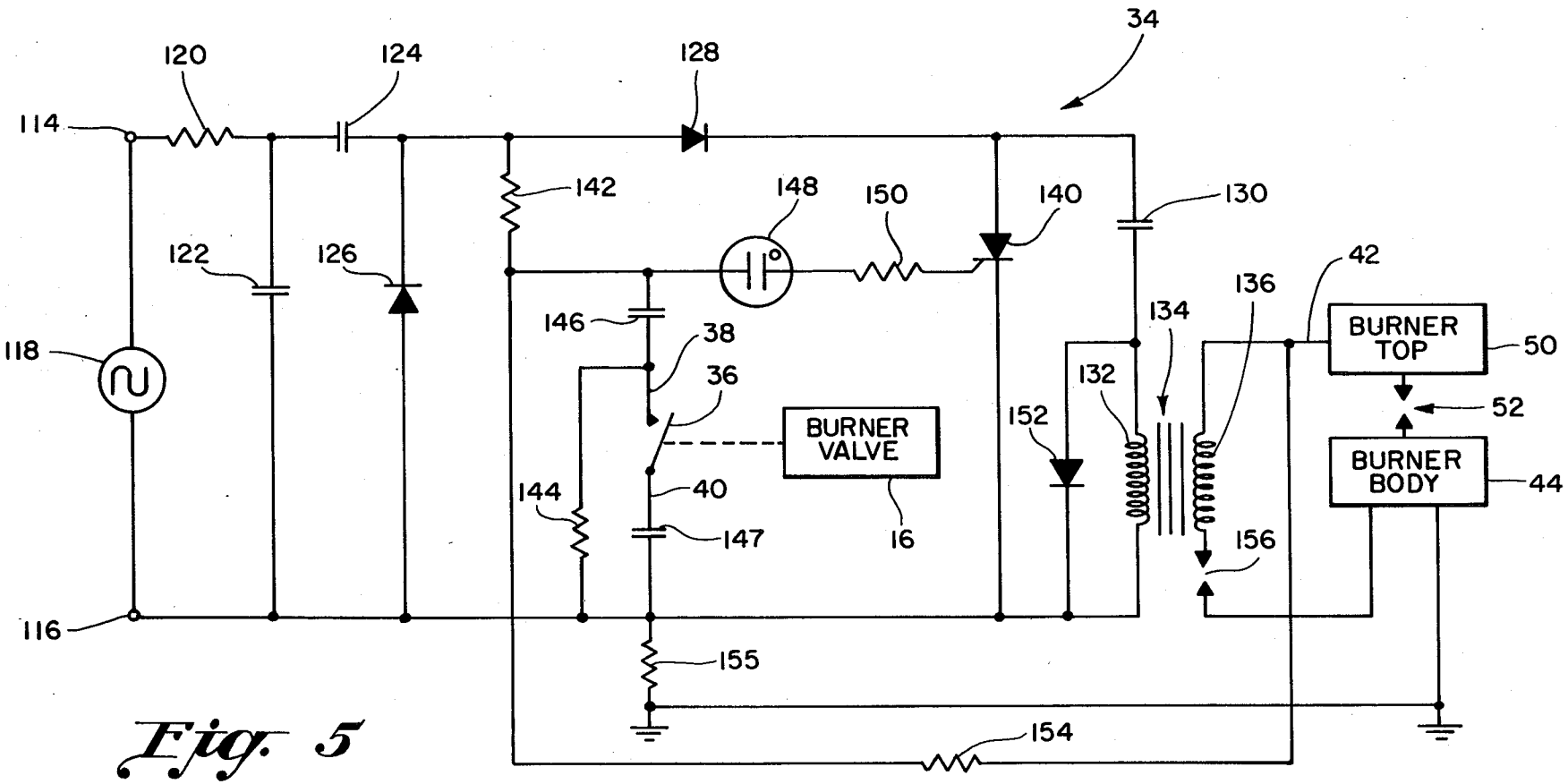
FIG. 5 is a schematic diagram of the ignition circuit of FIG. 1.

Ignition circuit 34 is schematically illustrated in FIG. 5. It should be understood that other types of ignition circuits may be used to provide spark ignition at the burner assembly 12. In the illustrated and preferred arrangement, circuit 34 includes a power supply line terminal 114 and a power supply neutral terminal 116 to be connected to a conventional 60 cycle nominal 110 volt AC power supply source 118. A line filter including a series connected resistor 120 and a capacitor 122 is connected between the power supply terminals 114 and 116. A voltage doubler including a capacitor 124 and diodes 126 and 128 is connected between the line filter and a charging capacitor 130. The charging capacitor 130 is connected in series with a primary winding 132 of an ignition transformer 134. The ignition transformer 134 includes a secondary winding 136 for providing a high voltage to the conductor 42 and the burner top 50.

The ignition circuit 34 includes a silicon controlled rectifier (SCR) 140 having an anode and cathode connected in parallel across the seriesconnected capacitor 130 and the primary winding 132 of the ignition transformer 134. The SCR 140 is rendered conductive or gated on under the control of a trigger circuit including the valve switch 36, a pair of voltage divider resistors 142 and 144 and a pair of timing capacitors 146 and 147, a neon voltage breakdown device 148 and a gate current limiting resistor 150. A diode 152 is connected across the primary winding 132 to prevent inductive voltage reversal in the winding 132 for the protection of the SCR 140.

In a standby condition, the valve 16 is in the closed position and the valve switch 36 is in the open position disabling the ignition circuit 34 because the voltage divider resistors 142 and 144 provide a voltage level substantially lower than a sufficient voltage level to cause conduction of the neon voltage breakdown device 144. When valve 16 is operated by knob 22 to any open position, the valve switch 36 is in the closed position to enable the ignition circuit 34. The valve switch 36 in the closed position enables the charging of the then series-connected capacitors 146 and 147 to the sufficient voltage level to cause conduction of the neon voltage breakdown device 144. The conduction of the neon voltage breakdown device 144 gates on the SCR 140.

In operation, when the SCR 140 is gated on or rendered conductive, the charging capacitor 130 discharges through the primary winding 132 of the ignition transformer 134 to effect the collapse of the field within the transformer 134. As a result, high voltage is induced in the secondary winding 136 causing ignition sparks to be produced at the ignition spark gap 52 between the burner top member 50 and the burner body 44.

When flame is present at the burner assembly 14, circuit 34 detects the presence of flame and discontinues ignition sparks. A flame detection circuit including resistor 154 is connected between the burner 50 and the junction of capacitor 146 and neon voltage breakdown device 148 by a circuit path including the conductor 42. A resistor 155 is connected between the neutral terminal 116 and a common ground potential at the burner body 44. Flame occurring at the spark gap 52 provides a conductive path through the spark gap 52 to the grounded burner body 44. This conductive path is in parallel with the series connected capacitor 146, burner valve switch 36 and resistors 144 and 155 and, when flame is present, prevents charging of capacitor 146 to a sufficient voltage level to render the neon voltage regulator device 148 conductive and thus, prevents triggering of the SCR 140. The secondary circuit of the ignition transformer 136 includes a secondary spark gap 156. Gap 156 prevents grounding of conductor 42 through the secondary winding 136 to the burner body 44 and thus prevents a false flame indication.

Briefly reviewing the operation of the burner assembly 12 and ignition circuit 34, when valve 16 is operated to an open position, gas is supplied through the orifice fitting 20 to the venturi 28 where it mixes with primary air to introduce a combustible air-gas mixture to the internal chamber 46 of the burner assembly. This fuel flows from chamber 46 through the main burner ports 48 and also through the ignition gas pathway comprised of the openings 78 and scallops 76 to the ignition region 80. Simultaneously, the ignition circuit 34 is enabled and ignition sparks are provided at the spark gap 52. Ignition gas flows around the entire periphery of the burner top member flange 86. Sparks are generated at one or more regions between the flange 86 and the fingers 88 in order to ignite the ignition gas exiting from the ignition gas pathway. Since the spark gap is not intended directly to ignite fuel from the main burner ports 48, reliable ignition is achieved throughout a wide range of gas flow rates selectable by the valve 16.

The ignition region 80 is coextensive with and lies directly above the burner ports 48 defined in the burner sidewall 54. Consequently, when ignition is achieved at the ignition region, fuel flowing from the main ports 48 is also reliably ignited at any selectable flow rate. Moreover, the symmetrical arrangement with the ignition region directly above the burner ports provides an efficient and non-turbulent flame pattern without any disruptions as would be caused by other lighter port configurations or the use of a probe type spark ignition electrode.

While the present invention has been described with reference to details of the preferred embodiments, those details are not intended to limit the scope of the invention as defined in the following claims.

What is claimed and desired to be secured by Letters Patent of the United States is:

1. A spark ignited gas burner assembly comprising in combination:

an electrically conductive sheet metal burner body including a sidewall;

an internal fuel chamber contained within said body;

means for supplying fuel to said chamber;

an array of main burner ports in said sidewall;

an electrically conductive burner top member overlying said burner body and said chamber;

spacer means sandwiched between said burner body and said top member for spacing apart said burner body and top member and for electrically isolating said top member from said burner body;

an ignition gas pathway defined between said burner body and top member extending independent of said main burner ports from said internal chamber to an ignition region above said main burner ports; and a spark ignition circuit including a spark gap in series circuit relationship between said burner body and said top member for providing ignition sparks in the ignition region.

2. The burner assembly of claim 1 wherein said sidewall is a generally circular cylindrical sheet metal part, said array of burner ports being generally circular around said sidewall, and said pathway being distributed around the periphery of said burner body.

3. The burner assembly of claim 2, said burner body including a bottom wall and said means for supplying fuel including a fuel inlet located at the center of said bottom wall.

4. The burner assembly of claim 3, further comprising a conductive rod offset from said inlet attached to said top member and extending through said chamber and through said bottom wall, and an insulating member electrically isolating said bottom wall and said rod.

5. The burner assembly of claim 1, said spacer means including an electrically insulating means and a conductive plate member forming a first electrode of said spark gap.

6. The burner assembly of claim 5 wherein said plate member abuts said burner body and said top member forms a second electrode of said spark gap.

7. The burner assembly of claim 1, said spacer means comprising a ceramic spacer element and a temperature-independent electrically insulating spacer element.

8. The burner assembly of claim 7 wherein said spark ignition circuit further includes means for detecting the presence or absence of flame at said spark gap.

9. The burner assembly of claim 2, said ignition gas pathway including numerous fuel paths defined by said spacer means and distributed uniformly around the periphery of said spacer elements.

* * * * *